United States Patent [19]

Savary

[11] 4,235,268

[45] Nov. 25, 1980

[54] TOOL FOR FORMING DOOR MORTICE

[76] Inventor: Clarence H. Savary, 1011 1/2 N. 3rd St., Ironton, Ohio 45638

[21] Appl. No.: 5,675

[22] Filed: Jan. 22, 1979

[51] Int. Cl.[3] ..... B27M 3/00

[52] U.S. Cl. ..... 144/27; 144/75; 144/326 R; 145/24

[58] Field of Search ..... 144/27, 75, 76, 84, 144/144.5, 323, 326 R; 145/24; 33/197

[56] References Cited

U.S. PATENT DOCUMENTS

| | | | |
|---|---|---|---|
| 724,966 | 4/1903 | Strubel | 144/27 |
| 1,417,431 | 5/1922 | Vogt | 144/27 |
| 1,430,874 | 10/1922 | Anderson | 144/27 |

FOREIGN PATENT DOCUMENTS

| | | | |
|---|---|---|---|
| 8431 | 4/1912 | United Kingdom | 144/27 |

*Primary Examiner*—W. Donald Bray

*Attorney, Agent, or Firm*—Berman, Aisenberg & Platt

[57] ABSTRACT

A simple, inexpensive and easy to use tool for forming a rectangular mortice in either a door or a doorjamb. The tool comprises a U-shaped frame member adapted to be clamped to the edge of the door or doorjamb. Two sets of slots are formed in the frame, each set adapted to receive a pair of cutters. One set is aligned for forming a rectangular mortice on the edge of a door, while the other set is utilized to form the mortice on a doorjamb. A third cutter tool may be provided. The slots and cutters are designed to eliminate guesswork in forming the rectangular mortice.

12 Claims, 4 Drawing Figures

TOOL FOR FORMING DOOR MORTICE

BACKGROUND OF THE INVENTION

1. Field of the Invention

The present invention is related to mortice forming tools and, more particularly, is directed towards a tool for forming a rectangular mortice in either a door or a doorjamb, such mortice being particularly designed to receive a standard hardware hinge.

2. Description of the Prior Art

Various tools have been designed to assist a workman in forming a rectangular mortice on the edge of a door or doorjamb. Such mortices are particularly designed to receive door hinges adapted to be secured therein.

One problem with the prior art tools is that the size of the mortice formed is open to guesswork, since the tools of the prior art are imprecise. Further, whereas one type of tool is generally required to form the slot in the edge of a door, another and different type of tool is required to form the same sized slot on a doorjamb.

It would obviously be highly advantageous if a single tool could be provided which is capable of enabling a workman to precisely form a rectangular mortice on both a door and a doorjamb. It is towards this end that the present invention is advanced.

OBJECTS AND SUMMARY OF THE INVENTION

It is therefore a primary object of the present invention to provide a tool which is particularly designed to form a rectangular mortice in both a door and a doorjamb.

Another object of the present invention is to provide a novel and unique tool for forming a door mortice which overcomes all of the deficiencies noted above with respect to prior art tools.

Another object of the present invention is to provide a tool for forming a mortice in a door or doorjamb which is inexpensive to manufacture, light in weight, and may be constructed of any suitable material.

An additional object of the present invention is to provide a novel and unique tool for forming a door mortice which is easy to use and permits precision and quick formation of the proper sized mortice in either a door or a doorjamb with equal facility.

The foregoing and other objects are attained in accordance with one aspect of the present invention through the provision of a tool for forming a rectangular mortice on the edge of a door, the mortice being of a length L, a width W, and a depth d. The tool comprises frame means adapted to be clamped to the edge of the door, first and second cutters each having a cutting blade of a length L, and first and second guide means substantially perpendicularly formed in the frame means for respectively receiving the first and second cutters therein. The first and second guide means each include means limiting the depth of penetration of the first and second cutters, respectively, to the width W and depth d.

In accordance with more specific aspects of the present invention, the frame means comprises first and second substantially parallel side frame members, and a pair of transverse frame members connecting the side frame members so as to form a substantially U-shaped structure adapted to be fitted about the edge of the door. Even more particularly, the first guide means are formed along the inside longitudinal edges of the pair of transverse frame members, while the second guide means are formed transversely to the first guide means a distance W from the opening side thereof.

In accordance with yet other aspects of the present invention, the first cutter comprises a body, a pair of guide members extending from the sides of the body and adapted to slide within the first guide means, and a substantially planar cutting blade extending from the body a distance spaced from the pair of guide members. The second cutter preferably comprises a handle, a flat cutting blade extending from the handle, and stop means for abutting the means for limiting the depth of penetration thereof.

In accordance with still other aspects of the present invention, the first side frame member includes means for clamping the frame means to the door, while the second side frame member is spaced from the first side frame member a distance at least as wide as the edge of the door.

In accordance with another unique aspect of the present invention, the second side frame member preferably includes means for receiving the first and second cutters for forming a substantially identically sized rectangular mortice on a doorjamb. The second side frame member in this regard includes a base and a pair of spaced side portions extending upwardly from the base to the pair of transverse frame members. The pair of spaced side portions each includes a side slot extending longitudinally therein and adapted to receive the pair of guide members of the first cutter. Another pair of guide slots extend transversely to the guide slots in the pair of spaced side portions and are formed at the intersection thereof with the base. The guide slots in the second side frame member are substantially perpendicular to the corresponding guide means formed on the pair of transverse frame members, inasmuch as the resultant rectangular mortices are substantially perpendicular. A third cutter having a blade may also be provided for cutting the width of the rectangular mortices.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
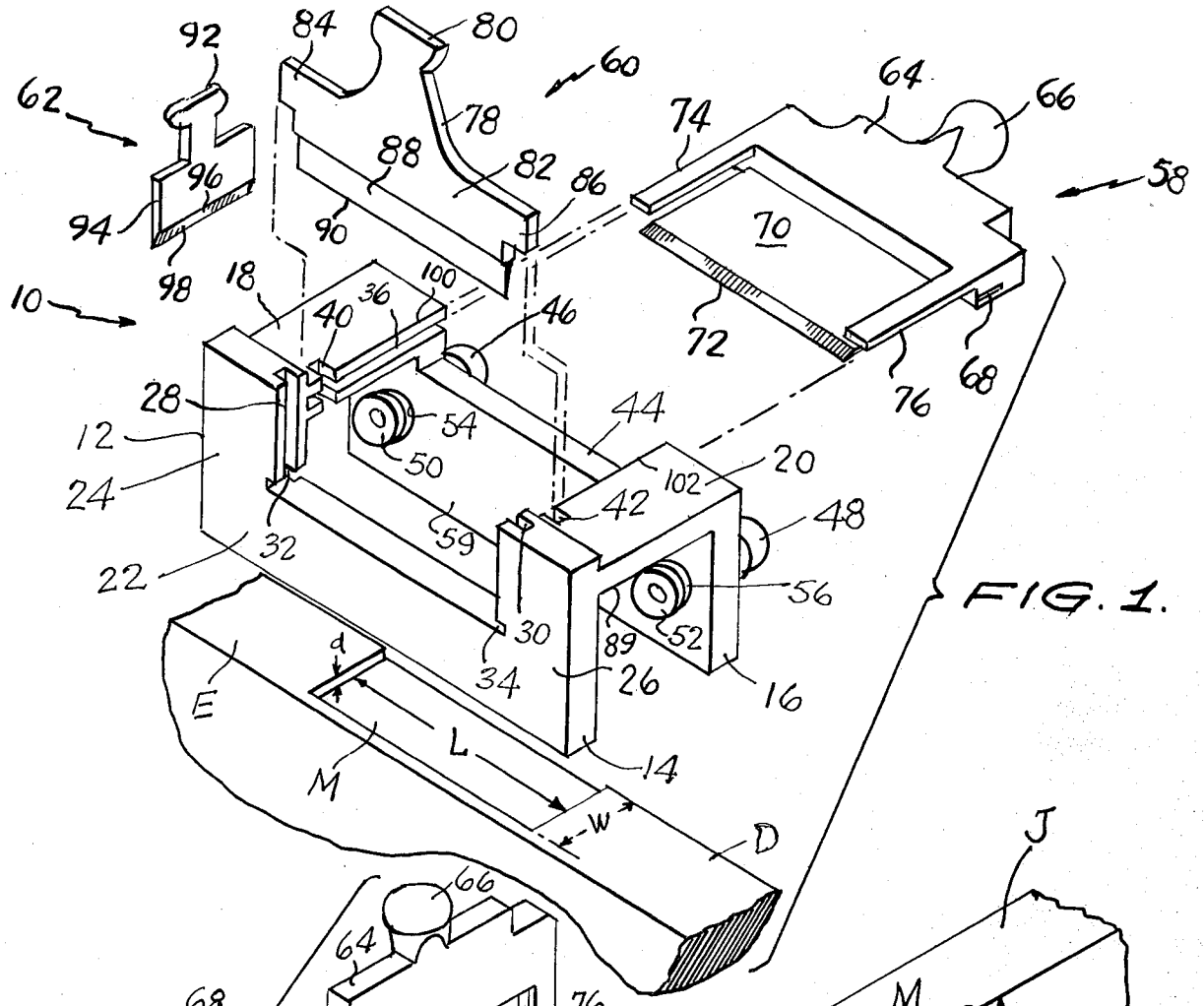
FIG. 1 is an exploded, perspective view of a preferred embodiment of the present invention shown prior to securing same to the edge of a door D preparatory to forming a rectangular mortice M therein.
Figure 2:
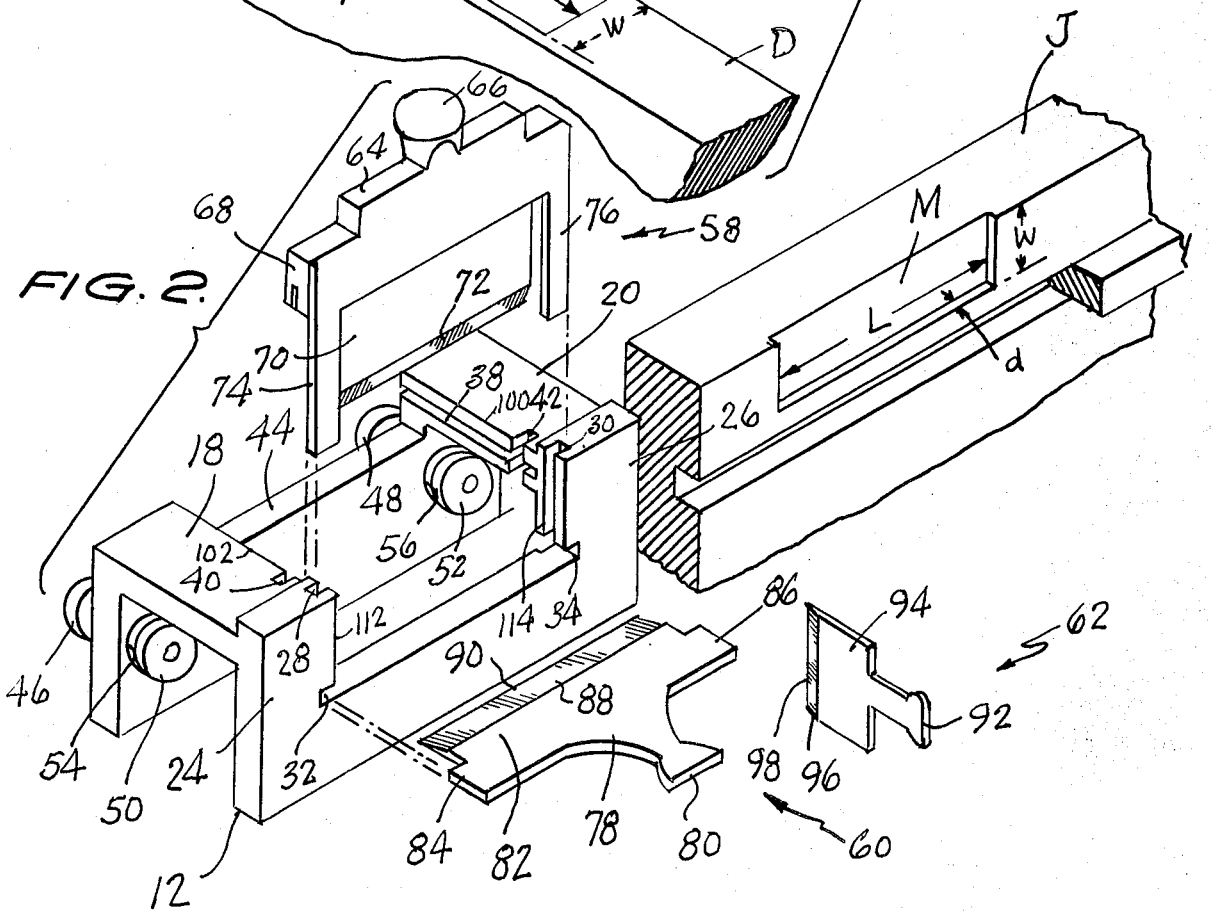
FIG. 2 is another perspective, exploded view of the preferred embodiment of the present invention shown prior to clamping thereof to the edge of a doorjamb J for forming a rectangular mortice M therein.

Referring now to the drawings, wherein like reference numerals represent identical or corresponding parts throughout the several views, and more particularly to FIG. 1 thereof, the tool of the present invention is indicated generally by reference numeral 10. The tool 10 includes a body or frame 12 which is adapted to be placed and clamped to the edge of either a door D (FIG. 1) or the edge of a doorjamb J (FIG. 2).

The frame 12 comprises a pair of opposing, substantially parallel side frame members 14 and 16 which are separated by a distance selected to be the maximum thickness of the edge of door D or jamb J.

The tool 10 of the present invention is particularly designed to form a rectangular mortice M in the edge of door D or jamb J. In both cases, the mortice M is of a standard length L, width W and depth d.

The side frame members 14 and 16 of frame 12 are connected at the ends thereof by transverse members 18 and 20 so as to form a substantially U-shaped frame 12.

Side frame member 14 includes a longitudinal base portion 22 from which extend upwardly two side portions 24 and 26 which are separated by a distance approximately equal to the length L of the mortice M to be formed.

Formed in the side portions 24 and 26 of side frame member 14 and extending downwardly along the inner side edges thereof are a pair of guide slots 28 and 30 which are provided for a purpose which will become more clear hereinafter.

Extending transversely to the guide slots 28 and 30 are formed at the intersection of base 22 with side portions 24 and 26 are an additional pair of guide slots 32 and 34, whose function will also be described in greater detail hereinafter.

Formed along the inner side edges of transverse frame members 18 and 20 are another pair of longitudinal guide slots 36 and 38 which are of a length and depth substantially equal to that of guide slots 28 and 30. Similarly, a pair of additional guide slots 40 and 42 extend transversely to guide slots 36 and 38 and are sized and positioned in a fashion analogous to that of guide slots 32 and 34, respectively.

The side frame member 16 includes a cutout portion 44 which is also of a length approximately equal to the length L of the mortice M. Cutout portion 44 is defined by the edges of the inner side walls of transverse frame members 18 and 20.

Formed in side frame member 16 are a pair of threaded clamp members 46 and 48 having seats 50 and 52 which are adapted to fit within recesses 54 and 56 formed in the inside wall 59 of side frame member 16. The threaded clamp members 46 and 48 are designed to be manipulated by hand and mate with tapped bores formed through side frame member 16.

The tool 10 of the present invention further includes a main cutter indicated generally by reference numeral 58, a large cutter-marker indicated generally by reference numeral 60, and a small cutter-marker which is indicated generally by the reference numeral 62.

Figure 3:
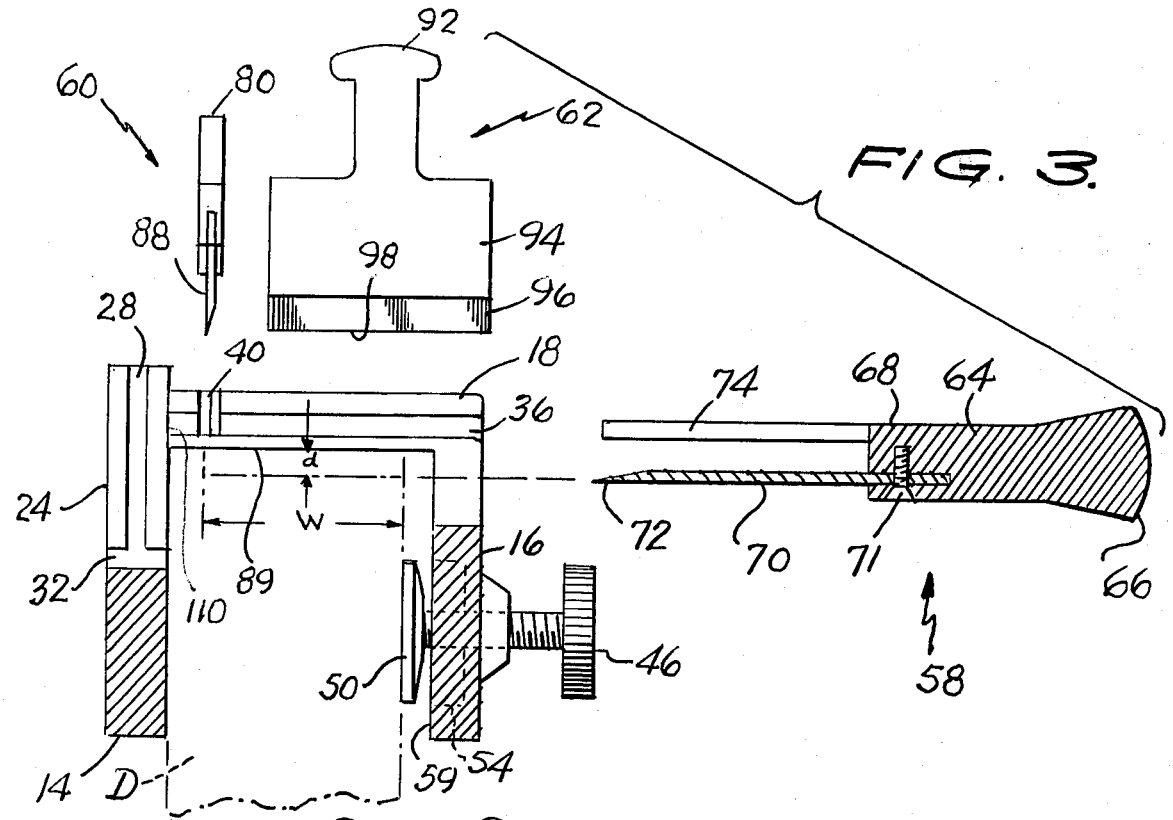
FIG. 3 is a cross-sectional side view, taken along line 3—3 of FIG. 4, illustrating the preferred embodiment of the present invention mounted on the door D of FIG. 1.
Figure 4:
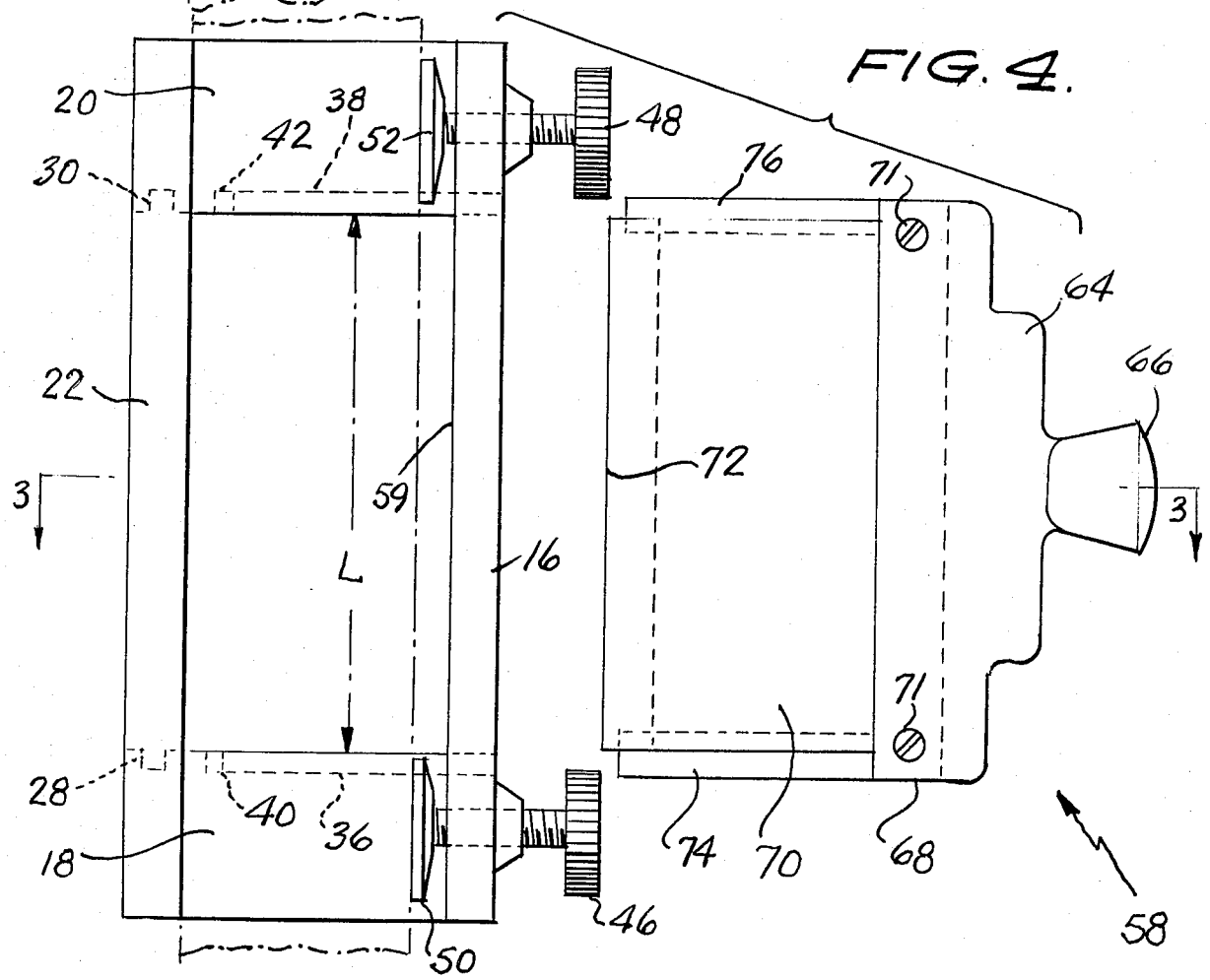
FIG. 4 is a bottom view of the preferred embodiment of the present invention illustrated in FIG. 3.

As illustrated with great particularity in FIGS. 3 and 4, the main cutter 58 comprises a handle 64 having a striking cap 66 extending outwardly from the central portion thereof. A blade holding portion 68 extends from handle 64 and is adapted to hold a substantially planar cutting blade 70 therein by means of, for example, screws 71. Blade 70 has a length equal to the length L of the mortice M to be formed and includes a forward cutting edge 72. A pair of longitudinal guide members 74 and 76 extend from the side portions of handle 64 and are spaced from the cutting blade 70 in the manner best illustrated in FIG. 3. Guide members 74 and 76 are particularly designed and sized to fit within guide slots 28 and 30 (see FIG. 2) and guide slots 36 and 38 (see FIG. 1).

The large cutter-marker 60 comprises a handle 78 having a striking cap 80 extending from the central portion thereof. A blade holding portion 82 extends from the handle 78 and is adapted to fit within guide slots 32 and 34 (FIG. 2) as well as guide slots 40 and 42 (FIG. 1). On the sides of blade holding portion 82 extend stop members 84 and 86 for controlling the depth of penetration of blade 88. Blade 88 includes a cutting edge 90 and is of a length equal to the length L of the mortice M to be formed. The stop members 84 and 86 are designed so that the blade 88 extends downwardly below the bottom surface 89 of transverse frame members 18 and 20 a distance equal to the depth d of the mortice M to be formed.

The small cutter-marker 62 comprises a striker portion 92 from which extends a blade holder 94 to which may be integrally formed a blade 96 having a cutting edge 98. The length of blade 96 is equal to the width W of the mortice M to be formed. Although no special guide slots are provided for the small cutter-marker 62 in frame 12, it is preferred to guide same along the inner side surfaces 100 and 102 of transverse frame members 18 and 20, respectively, in a manner which will become more clear hereinafter.

Referring now to FIG. 1, the operation of the present invention will be explained in connection with the formation of a mortice M in the edge of a door D. Initially, the frame 12 is secured to the edge of door D in the manner illustrated in FIG. 3. If the thickness of the door is less than the distance between side frame members 14 and 16, clamp members 46 and 48 may be manually turned to secure the frame 12 in position wherein the bottom surface 89 of transverse frame members 18 and 20 rests securely against the top edge E of the door D. The large cutter-marker 60 is then positioned through slots 40 and 42 to mark and cut the exact depth d and length L necessary to form mortice M. Stop members 84 and 86 abut the top surfaces of transverse frame members 18 and 20 to insure proper penetration. Cutter-marker 60 is then removed, and the small cutter-marker 62 is utilized adjacent the inner side surfaces 100 and 102 of transverse frame members 18 and 20 for making the side cuts of a length W and depth d. After those three cuts are made, and the cutter-markers 60 and 62 are removed, the main cutter 58 is inserted by guiding members 74 and 76 into slots 36 and 38. The cap 66 may be tapped with a hammer a sufficient number of times to force cutting blade 70 inwardly until the cut is complete. The abutment of guide members 74 and 76 against the rear edge 110 of the slots 36 and 38 insures completion of the job.

In a similar manner, referring now to FIG. 2, a mortice M of the exact same size as that formed in the door D of FIG. 1 may be formed in the jamb J. The frame member 12 is secured to the edge of the jamb J in the orientation illustrated in FIG. 2. The large cutter-marker 60 is in this instance inserted through slots 32 and 34, and then the small cutter-marker 62 is positioned against inside edges 112 and 114 of side portions 24 and 26 to make the side cuts of a length W. Then, after removing the cutter-markers 60 and 62, the main cutter 58 is inserted through slots 28 and 30, and proper force is exerted on striking cap 66 to form the mortice M.

It may be appreciated, therefore, that the present invention takes the guesswork out of forming a rectangular mortice in either a door or doorjamb, and performs same with equal facility and precision. Quite obviously, different sizes of the present invention may be utilized to form differently sized mortices. The present invention may be constructed of any suitable material, such as wood or plastic, and may be light in weight and inexpensive to manufacture.

Obviously, numerous modifications and variations of the present invention are possible in light of the above teachings. It is therefore to be understood that within the scope of the appended claims, the invention may be practiced otherwise than as specifically described herein.

I claim as my invention:

1. A tool for forming a rectangular mortice on the edge of a door or doorjamb, said mortice being of a length L, width W and depth d, which comprises:

frame means adapted to be clamped to said edge of said door or doorjamb;

first and second cutters each having a cutting blade of a length L;

first and second guide means substantially perpendicularly formed in said frame means for respectively receiving said first and second cutters therein; and third and fourth guide means substantially perpendicularly formed in said frame means for respectively receiving said first and second cutters therein, said third and fourth guide means substantially perpendicular to said first and second guide means, respectively.

2. A tool as set forth in claim 1, wherein said first and second guide means each include means for limiting the depth of penetration of said first and second cutters, respectively, to said width W and said depth d.

3. A tool as set forth in claim 2, wherein said frame means comprises:

first and second substantially parallel side frame members; and a pair of transverse frame members connecting said side frame members so as to form a substantially U-shaped structure adapted to be fitted about said edge of said door.

4. A tool as set forth in claim 3, wherein said pair of traverse frame members have spaced-apart, opposing inside longitudinal edges, said first guide means are formed along said inside longitudinal edges of said pair of transverse frame members, and said second guide means are formed in said inside longitudinal edges transversely to said first guide means.

5. A tool as set forth in claim 4, wherein said first cutter comprises a body, a pair of guide members extending from the sides of said body and adapted to slide within said first guide means, and a planar cutting blade extending from said body a distance spaced from said pair of guide members.

6. A tool as set forth in claim 5, wherein said second cutter comprises a handle, a flat cutting blade extending from said handle, and stop means for abutting said means for limiting the depth of penetration thereof.

7. A tool as set forth in claim 6, wherein said first side frame member includes means for clamping said frame means to said door.

8. A tool as set forth in claim 7, wherein said second side frame member is spaced from said first side frame member a distance at least as wide as said edge of said door.

9. A tool as set forth in claim 8, wherein said second side frame member comprises:

a base and a pair of spaced side portions extending upwardly from said base to said pair of transverse frame members.

10. A tool as set forth in claim 9, wherein said third guide means comprises a guide slot formed in each of said pair of spaced side portions, said guide slots extending longitudinally therein and adapted to receive said pair of guide members of said first cutter.

11. A tool as set forth in claim 10, wherein said fourth guide means comprises a pair of guide slots extending transversely to said guide slots of said third guide means in said pair of spaced said portions and formed at the intersection thereof with said base.

12. A tool as set forth in claim 11, further comprising a third cutter having a blade adapted to cut the width of said rectangular mortices, said third cutter further adapted to be guided along the inside longitudinal edges of said traverse members upon cutting of the mortice width.

* * * * *